US005737862A

United States Patent [19]

Cooper et al.

[11] Patent Number: 5,737,862

[45] Date of Patent: Apr. 14, 1998

[54] PORTABLE SIGN

[76] Inventors: Garry T. Cooper, 79 McVeigh Street, Barrie, Ontario, Canada, L4M 7E4; J. Murray Wright, 3 Springdale Cresent, Barrie, Ontario, Canada, L4M 5A7

[21] Appl. No.: 713,363

[22] Filed: Sep. 13, 1996

[30] Foreign Application Priority Data

Sep. 20, 1995 [CA] Canada ..... 2158666

[51] Int. Cl.[6] ..... G09F 7/04

[52] U.S. Cl. ..... 40/606; 40/621

[58] Field of Search ..... 40/600, 621, 606, 40/611, 594, 595; 248/188.1, 188.2; 160/351

[56] References Cited

U.S. PATENT DOCUMENTS

| | | | |
|---|---|---|---|
| 1,768,672 | 7/1930 | Diffin | 40/452 |
| 2,962,132 | 11/1960 | Reinhardt | 160/351 X |
| 3,713,474 | 1/1973 | Orlando | 160/351 |
| 3,798,814 | 3/1974 | Harmon | 40/590 |
| 3,928,921 | 12/1975 | Gurman | 40/621 |
| 4,507,888 | 4/1985 | Robinson et al. | 40/621 |
| 4,583,312 | 4/1986 | King et al. | 40/450 X |
| 4,976,055 | 12/1990 | Kane | 40/600 X |
| 5,203,847 | 4/1993 | Butt | 273/157 R |

FOREIGN PATENT DOCUMENTS

| | | | |
|---|---|---|---|
| 2682795 | 4/1993 | France | 40/621 |
| 2079023 | 1/1982 | United Kingdom | 40/611 |

*Primary Examiner*—Cassandra Davis
*Attorney, Agent, or Firm*—Rogers & Milne

[57] ABSTRACT

A portable sign having a magnetically attractable signboard, a frame supporting the signboard and a support for supporting the frame. Graphic elements cut from a magnetic material are releasably securable to the signboard by magnetic attraction without constraint as to location.

5 Claims, 2 Drawing Sheets

PORTABLE SIGN

FIELD OF THE INVENTION

This invention relates to portable signs and more particularly to portable signs with interchangeable messages.

BACKGROUND OF THE INVENTION

Many businesses use portable signs to draw attention to their location and to notify passers by of promotions that are currently being featured. An advantage of portable signs is that they can be located away from the premises of a business in a high traffic area. This is particularly advantageous where a business is situated in a location that might otherwise escape the attention of passers by such as a mall or business park which is removed from a roadway, adjacent other businesses and separated from the roadway by a parking lot or other obstruction. In such circumstances, a portable sign can be placed adjacent the roadway so as to catch the attention of drivers and pedestrians passing along the roadway.

Portable signs are a valuable marketing tool because unlike many other advertising media, portable signs reach customers when they are close to the business. In contrast, radio, television and newspapers are relatively expensive and generally reach a target audience when they are far removed from the business.

Heretofore, portable signs have not been as effective as desirable because visual impact has been sacrificed for ready interchangeability of messages.

Prior portable signs are essentially of two styles, namely, backlit and non-backlit. In either case, single letters are presented on rectangular cards, the size and placement of the cards being determined by parallel horizontal channels or similar mounting means to secure the cards to a signboard. Such a configuration is frustrating to a graphic artist as it has limited sign design to letters laid out in parallel rows, having a fixed height and not being superimposable on different backgrounds. This has resulted in a very homogeneous and "non-professional" appearance. For example, messages couldn't be laid out in blocks of information having different letter sizes, the use of graphics was very limited and variations in horizontal spacing were quite constrained. Often, for example, the letter "T" and the letter "W" would be placed on similarly sized cards creating gaps and crowding. Furthermore, the edge of the cards would limit how closely such letters as "W", "A" and "T" could be moved together to create visually correct spacing.

It is an object of the present invention to provide a portable sign with readily interchangeable messages that can be placed anywhere on a signboard without the constraint of horizontally parallel rows imposed by securing means securing the letters to the signboard.

It is a further object of the present invention to provide a portable sign having superimposable message elements.

It is a still further object of the present invention to provide a portable sign in which the size of graphics and letters is not constrained by securing means laid out in horizontally parallel rows.

It is another object of the present invention to provide a portable sign in which graphic elements other than letters can be used in conjunction with letters in a virtually unrestricted manner.

It is yet another object of the present invention to provide a portable sign in which neither letters nor other graphic elements have to be printed on rectangular cards for mounting purposes.

SUMMARY OF THE INVENTION

A portable sign comprising:

a magnetically attractable signboard;

a frame for supporting said signboard;

a support for supporting said frame; and, graphic elements cut from a magnetic rubber material, releasably securable to said signboard by magnetic attraction without constraint by the position of any mechanical securing means.

DESCRIPTION OF DRAWINGS

Preferred embodiments of the invention are described below with reference to the accompanying drawings in which.

DESCRIPTION OF PREFERRED EMBODIMENTS

Figure 1:
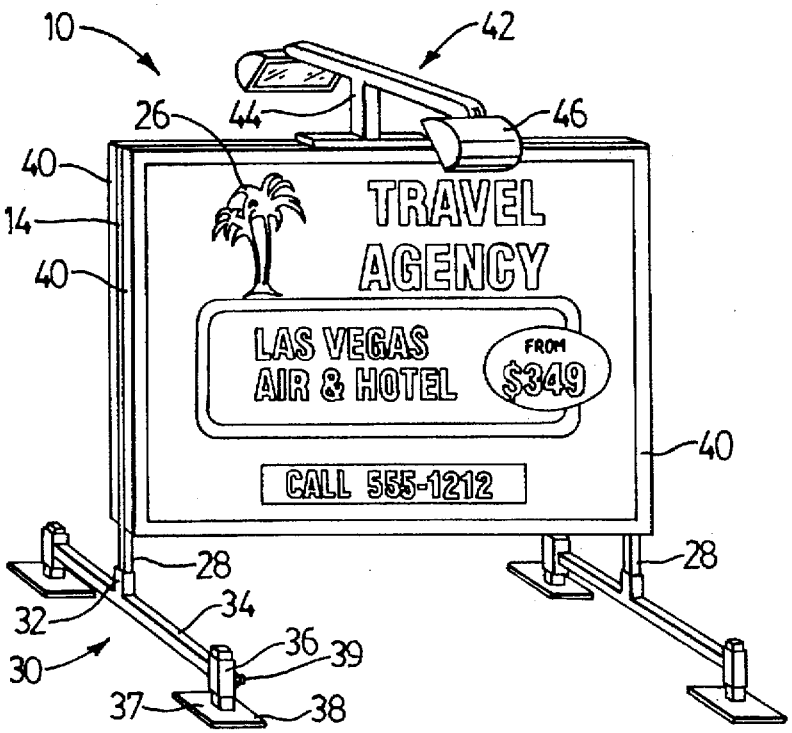
FIG. 1 is a perspective view of an embodiment of a sign of the invention; showing an example of a combination of individual, graphics used to produce a multi-colored display advertisement for a travel agency.
Figure 2:
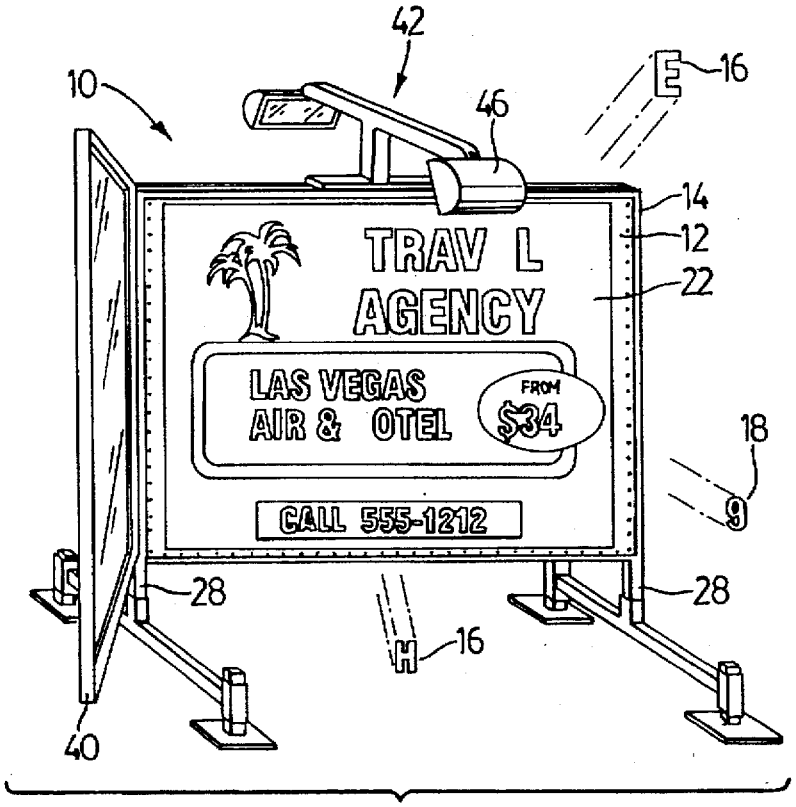
FIG. 2 is a perspective view of the sign shown in FIG. 1 with the gate open and showing that the individual letters and numbers are removable.
Figure 3:
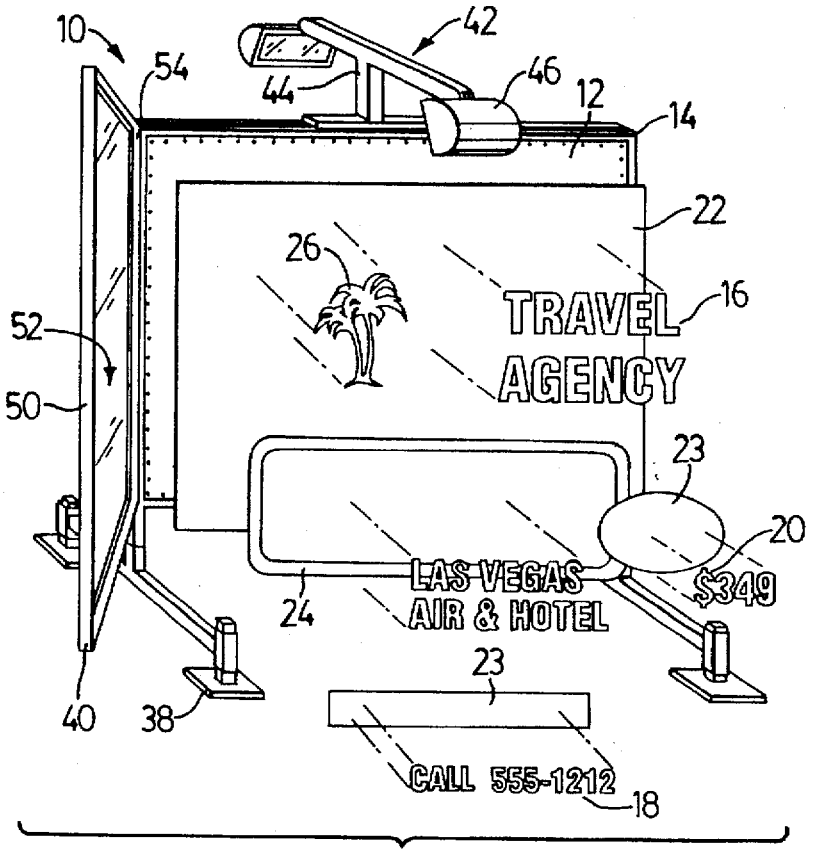
FIG. 3 is a perspective view of a sign shown in FIG. 1 with the gate open and showing the individual graphics used in combination to produce the advertisement in this example.
Figure 4:
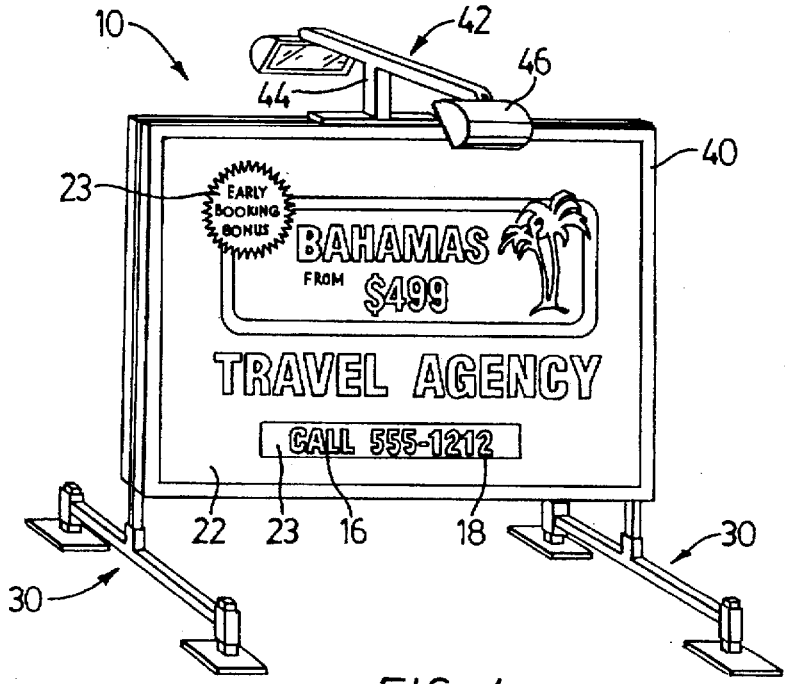
FIG. 4 is a perspective view of a sign as shown in FIG. 1 with an example of an alternate combination that the travel agency might choose to use.

A portable sign according to the present invention is generally indicated by reference 10. The sign 10 has an upstanding rectangular signboard 12 which is made from a magnetically attracted material such as steel sheet which may also be galvanized and painted.

The signboard 12 is mounted in a frame 14 which extends around the perimeter of the signboard 12. The frame may be made from square cross-section steel tubing. The frame 14 may be supported by a support such as the removable stand assembly 30 on each side. Each stand assembly 30 includes a horizontal member 34 having a socket 36 at each end. Adjustable legs 38 are connected to the sockets 36 by means of upright members 37 that are received by the sockets 36. The upright members 37 may be of square cross-section steel tubing having dimensions slidably receivable by the sockets 36. Locking means such as bolts 39 extending through the sockets 36 enable the legs 38 to be secured into position. Adjustable legs 38 are desirable to accommodate varying ground conditions.

The frame 14 has downwardly extending posts 28 on either side thereof. The downwardly extending posts 28 are received by tubular receptacles 32 extending upwardly from the stand assembly 30 approximately midway along its length.

Text elements of various colours such as letters 16, numbers 18 and symbols 20 are individually cut from coloured magnetic rubber. Presentation elements of various colours such as background mats 22, small mats or "text boxes" 23 of various sizes and shapes to visually isolate portions of text, borders 24 and symbols 26 are also cut from magnetic rubber. The magnetic rubber can be cut by means of a computer generated plotter of a type that is used in the vinyl graphics industry.

The text elements and presentation elements are more broadly referred to herein as "graphic elements". The graphic elements releasably adhere to the signboard 12 by virtue of magnetic attraction between the magnetic rubber of the graphic elements and the magnetically attractive material of the face of the signboard 12.

As the entire face of the signboard 12 is magnetically attractive, the graphic elements may be of any size and placed anywhere without being restricted by grooves on a sign face.

The graphic elements are also attracted to one another magnetically, and many therefore be superimposed as illustrated. Accordingly, unlike previous portable signs, graphic presentation is virtually unhindered by the apparatus which enables message interchangeability. Also, having letters 16 individually cut to shape rather than printed on a rectangular card allows for adjustment to the horizontal juxtapositioning of the letters to enable visually correct spacing. An example of this may be seen in the word "TRAVEL" illustrated where the upper left corner of the letter "V" is above rather than beside the lower right corner of the letter "A".

Letters 16 of different sizes may be grouped together as desired and symbols 26 of any size and shape may be used, once again unfettered by the securing means to the signboard 12.

In order to prevent unwanted access to the graphic elements, for example by vandals, a cover 40 is provided. The cover 40 has a rectangular frame 50 which supports a mesh screen 52. The frame 50 may be made from angle iron and the mesh screen 52 may be made from galvanized wire. The cover 40 may be hingedly attached to the frame 14, for example along a side edge 54.

Illumination assembly 42 may also be provided such as by lights 46 supported from the frame 14 by a T-shaped frame 44 which may also be of tubular steel. The lights 46 may be multi-position floodlights preferably rated at 500 watts each, however this may vary depending on sign size, colour and possibly other criteria.

It is intended that the above description be interpreted in an illustrative rather than a restrictive sense. Variations to the features described above may be apparent to those skilled in such structures without departing from the spirit and scope of the invention as defined by the claims set out below.

We claim:

1. A portable sign comprising:

a magnetically attractable signboard presenting a neutral background devoid of any locating indicia and any mechanical securing means;

a frame supporting said signboard;

a support for supporting said frame;

graphic elements cut from a magnetic rubber material releasably securable to said signboard by magnetic attraction without mechanical or visual constraint;

a mesh screen hingedly secured to said frame and movable from an open position permitting access to said graphic elements to a closed position covering said graphic elements to inhibit access to said graphic elements;

said frame releasably attaching to said support by posts extending downwardly from said frame which are received in receptacles extending upwardly from said support;

said support including a pair of horizontal members from each of which one of said receptacles extends;

said support further including adjustable legs upon which said support rests to allow longitudinal and lateral levelling of said support;

said adjustable legs are provided at each end of said horizontal member and include an upright member which is slidably received by a socket at each end of each said horizontal member;

releasable locking means are provided between each said socket and corresponding upright member to releasably secure said socket to said upright member to prevent relative movement therebetween, said upright member being freely slidable in said socket when said releasable locking means is released;

said graphic elements including at least one member from the group consisting of letters, numbers, symbols, background mats and text boxes; and, said graphic elements are magnetically attracted to each other and to said signboard to allow said graphic elements to be superimposed on one another on said signboard.

2. A portable sign as claimed in claim 1 wherein at least one light is secured to said frame and directed at a face of said signboard for illuminating said sign.

3. A portable sign as claimed in claim 1 wherein said signboard has two oppositely facing faces and at least one light directed at each of said faces, each said light being secured to said frame.

4. A portable sign as claimed in claim 2 wherein said graphic elements include at least one member selected from a first group consisting of letters, numbers and symbols;

said graphic elements further include at least one member selected from a second group consisting of background mats and text boxes;

said member from said first group being of a different colour from and superimposed on said member from said second group.

5. A portable sign as claimed in claim 3 wherein said graphic elements include at least one member selected from a first group consisting of letters, numbers and symbols;

said graphic elements further include at least one member selected from a second group consisting of background mats and text boxes;

said member from said first group being of a different colour from and superimposed on said member from said second group.

* * * * *